United States Patent [19]

Siemon

[11] Patent Number: 4,702,540

[45] Date of Patent: Oct. 27, 1987

[54] ELECTRICAL CONNECTOR HOLD-DOWN ADAPTOR

[75] Inventor: John A. Siemon, Watertown, Conn.

[73] Assignee: The Siemon Company, Watertown, Conn.

[21] Appl. No.: 893,493

[22] Filed: Aug. 5, 1986

[51] Int. Cl.[4] ..... H01R 13/631

[52] U.S. Cl. ..... 439/371; 439/471

[58] Field of Search ..... 339/75 M, 75 P, 103 R, 339/103 M, 104

[56] References Cited

U.S. PATENT DOCUMENTS

| | | | |
|---|---|---|---|
| 4,099,819 | 7/1978 | Keglewitsch | 339/75 M |
| 4,121,880 | 10/1978 | Rollins | 339/104 |
| 4,343,525 | 8/1982 | Knickerbocker | 339/75 P |
| 4,463,999 | 8/1984 | Knickerbocker | 339/75 P |
| 4,566,185 | 1/1986 | Bryan et al. | 339/75 P |

OTHER PUBLICATIONS

IBM Technical Disclosure Bulletin, vol. 21, No. 2, Jul. 1978, "Retaining Strap Arrangement", Bucher, Jr.

*Primary Examiner*—John McQuade

*Attorney, Agent, or Firm*—Fishman & Dionne

[57] ABSTRACT

An apparatus for releasably securing mating electrical connectors is presented which employs a bracket having an apertured portion which is sized and shaped to circumscribe the mating portions of the connectors. In a first embodiment, the bracket has a pair of opposed arm portions extending therefrom with at least one slot centrally located on one of the arms and a pair of opposed open ended slots on the other arm. A self-locking strap is secured to the centrally located slot. In use, after the bracket has been placed on the first connector and the mating connector is joined thereto, the self-locking strap will be wound tightly around the mating connector through the two open-ended slots; and locked to itself to thereby retain the connectors in the engaged condition. The connectors may be disengaged merely by applying sufficient force to the strap so as to unlock it from itself. In a second embodiment, the bracket includes a pair of opposed arm portions extending therefrom with at least one slot centrally located on one of the arms and a pair of mating opposed closed slots on the other arm. A forked self-locking strap is attached to each of the pair of opposed slots and looped through the single closed slot on the opposing side as a means for securing the mated connector.

21 Claims, 13 Drawing Figures

ELECTRICAL CONNECTOR HOLD-DOWN ADAPTOR

BACKGROUND OF THE INVENTION

This invention reltes to an adaptor for reliably and easily preventing undesired separation of the mating portions of communications systems cable connectors. Specifically, this invention relates to securing mating electrical cable connectors to one another with ease through the use of a universal adaptor characterized by minimal cost.

A problem instant to the use of presently available cable connectors for establishing electrical connections between the conductors of a pair of multi-conductor communications cables resides in the fact that the connectors may disengage while in service. The prior art discloses numerous methods to alleviate this problem. Thus, for example, some cable connectors are manufactured and designed so that they snap together. Other previously employed methods of fastening cable connectors together involve the use of bail hooks, springs or similar devices. Also, many cable connectors are provided with threaded fittings whereby the male and female connectors may be joined together by means of bolts.

While the prior art demonstrates various methods of securing mating cable connectors together, these prior methods all have one or more deficiencies. Thus, by way of example, those prior art connectors which are manufactured so as to be self-fastening cannot be employed with non-compatible connectors and thus their usefulness is limited. Further, the joining and disconnecting of prior art cable connectors, particularly those that are bolted together, is a time consuming and thus expensive procedure. Additionally, the prior art securing techniques do not aid in identifying specific cables, this being a particular problem when the cables are located in a crowded environment.

U.S. Pat. No. 4,463,999 (assigned to the assignee hereof and incorporated herein by reference) overcomes the above-discussed disadvantages of the prior art by providing an improved device for simultaneously securing and releasing mating cable connectors to one another and identifying the associated cables.

The apparatus disclosed in U.S. Pat. No. 4,463,999 employs a bracket having an apertured portion which is sized and shaped to circumscribe the mating portions of the connectors. The bracket is provided with at least one slotted extension to which a self-locking strap is secured. In use, after the bracket has been placed on the first connector and the mating connector is joined thereto, the self-locking strap will be wound tightly around the pair of connectors and locked to itself to thereby retain the connectors in the engaged condition. The connectors may be disengaged merely by applying sufficient force to the strap so as to unlock it from itself. Through the use of color coded straps, the cables extending from the connectors may be labeled according to function.

While well suited for its intended purpose, the apparatus disclosed in U.S. Pat. No. 4,463,999 does suffer from several deficiencies. For example, while the apparatus described in U.S. Pat. No. 4,463,999 easily effects connection between cable connectors of the type wherein the cable extends laterally from the connector housing, connection is extremely difficult when connecting cable connectors of the type wherein the cable extends outwardly from the middle of the top portion of the cable connector. Such cable connectors are well known and include, for example, the majority of those connectors referred to as D-sub miniatures, the standard connectors which are used for RS-232 computer interfaces. It will be appreciated that the self-locking strap from the prior art apparatus (U.S. Pat. No. 4,463,999) will be precluded from being wrapped about the D-sub miniature connector due to the obstruction caused by the top cable exiting the housing.

SUMMARY OF THE INVENTION

The above-discussed and other problems of the prior art are overcome or alleviated by the improved apparatus for releasably securing mating electrical connectors in accordance with the present invention. Apparatus in accordance with a first embodiment of the present invention employs a bracket having an apertured portion which is sized and shaped to circumscribe the mating portions of the connectors. The bracket has a pair of opposed arm portions extending therefrom with at least one slot centrally located on one of the arms and a pair of opposed open ended slots on the other arm. A self-locking strap is secured to the centrally located slot. In use, after the bracket has been placed on the first connector and the mating connector is joined thereto, the self-locking strap will be wound tightly around the mating connector or the pair of connectors through the two open-ended slots; and locked to itself to thereby retain the connectors in the engaged condition. The connectors may be disengaged merely by applying sufficient force to the strap so as to unlock it from itself.

In a second embodiment of the present invention, the open ended slots are closed. A self locking strap having a "Y" or forked configuration is then attached to the two closed slots (via the two forked ends). The unitary portion of the strap is fed through the single slot on the opposed arm whereupon it is locked upon itself to thereby retain the connectors in the engaged condition.

In the first embodiment, the self-locking strap is provided with a section of hooks on opposed ends adjacent a section of loops; with the hooks and loops at one end being on the front surface of the strap and the hooks and loops at the self-locking other end being on the back strap surface. In the second embodiment, the strap has a first section of hooks or loops at the unitary end thereof with a second section of loops or hooks adjacent the first section on the same side thereof. The use of these self-locking straps combined with the associated brackets constructed with the slot configurations discussed above permits attachment between mating connectors wherein at least one connector has a cable extending from the middle of the upper surface thereof (in contrast to those connectors wherein the cables extends laterally from the cable housing).

The above discussed and other features and advantages of the present invention will be apparent to and understood from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figures 1, 2, 3, 4, 5:
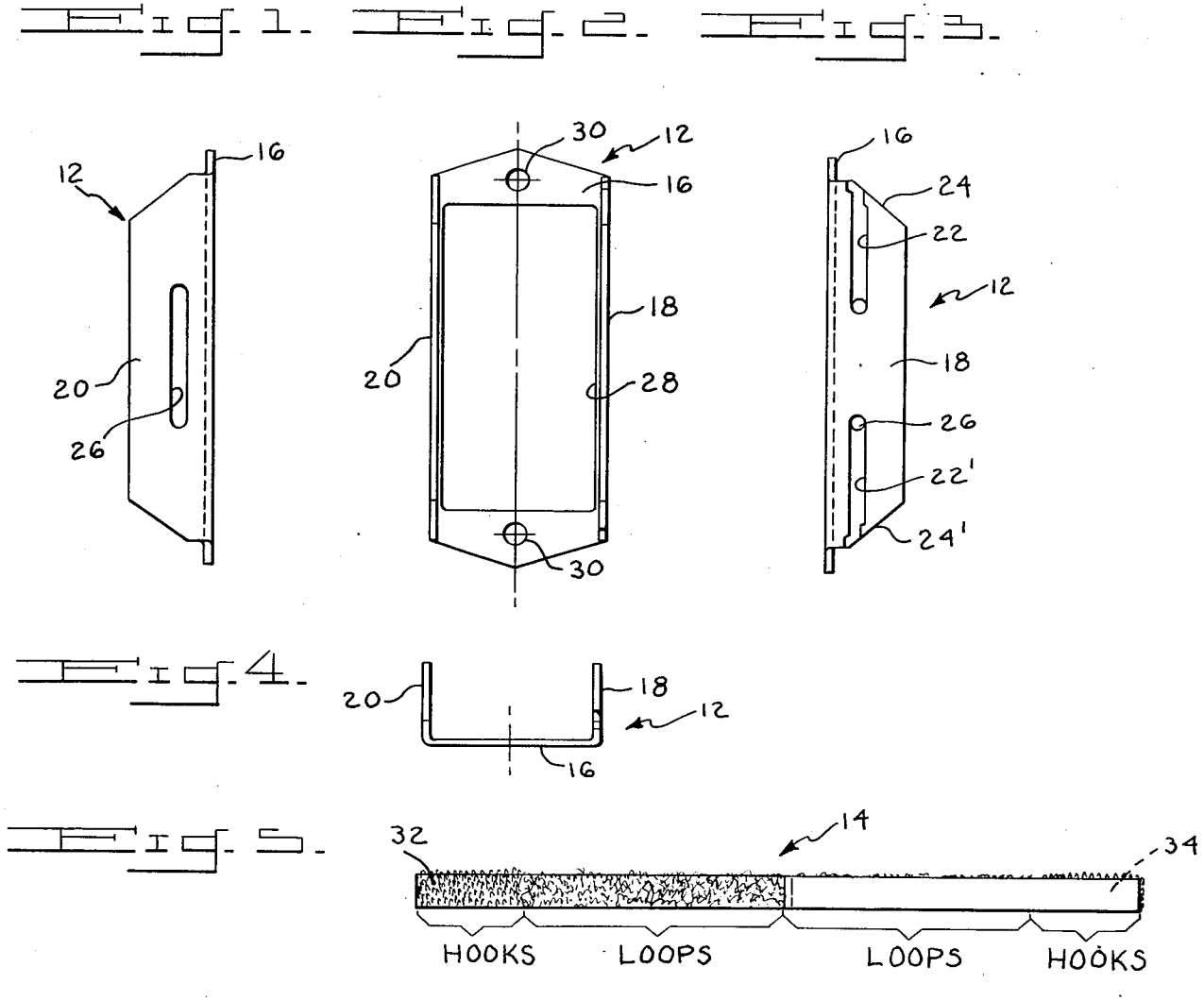
FIG. 1 is a left side elevation view of the bracket portion of an adaptor in accordance with a first embodiment of the present invention.
FIG. 2 is a front elevation view of the bracket of FIG. 1.
FIG. 3 is the right side elevation view of the bracket of FIG. 1.
FIG. 4 is an end view of the bracket of FIG. 1.
FIG. 5 is a plan view of a self-locking strap used in conjunction with the bracket of FIG. 1 and in accordance with a first embodiment of the present invention.
Figure 6:
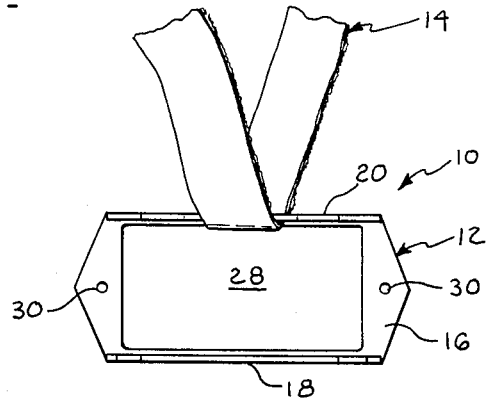
FIG. 6 is a front view of the assembled bracket and strap of the adaptor of a first embodiment of the present invention.

Referring simultaneously to FIGS. 1 through 6, an adaptor in accordance with the present invention is shown generally at 10 in FIG. 6. Adaptor 10 comprises a bracket 12 and a strap 14. Bracket 12 is preferably formed as a metal stamping. Bracket 12 is generally "U" shaped with a flat bottom portion 16 and a pair of oppositely disposed flat arms or extensions 18 and 20 which extend outwardly therefrom. Arms 18 and 20 are preferably transversely oriented with respect to base 16 and have the irregular shape which may best be seen from FIGS. 1 and 3. Arm 18 is provided with a pair of oppositely disposed open ended slots 22 and 22' which extend inwardly toward one another from opposed side surfaces 24 and 24' of arm 18. Arm 20 includes at least one closed slot 26. Slot 26 is preferably centrally disposed along arm 20. Bottom portion 16 of bracket 12 is provided with a substantially rectangularly shaped central cut-out 28. Additionally, in the preferred embodiment, base 16 is provided with a pair of oppositely disposed and aligned mounting holes 30.

As mentioned, the adaptor of the present invention also includes a strap 14 which is of the self locking type. In a preferred embodiment, strap 14 includes sections of hooks and loops commercially available under the trademark "Velcro". Also, in a preferred embodiment, the self-locking strap is provided with a section of hooks on opposed ends adjacent a section of loops with the hooks and adjacent loops at one end being on the front surface 32 of the strap, and the hooks and loops at the other end being on the back surface 34 of strap 14. It will be appreciated that when the adjacent areas of hooks and loops contact one another, a relatively strong attachment will be effected thereby. It will be understood that the particular configuration of the hooks and loops may be interchanged so long as the front surface 32 of strap 14 has a group of hooks and loops at one end thereof; and the back surface 34 of strap 14 has a group of hooks and loops at a second end, opposite the first end.

In FIG. 6, adapter 10 is shown subsequent to assembly wherein one end of strap 14 has been passed through closed slot 26 of arm 20. At this point, the groups of hooks and loops on the front and back sides of strap 14 will be facing the same direction. Preferably, about one half of strap 14 is brought through slot 26 whereupon the strap may be permanently secured to bracket 12 by heat sealing or other means thereby securing strap 14 to itself so that strap 14 surrounds a portion of arm 20.

Figure 7:
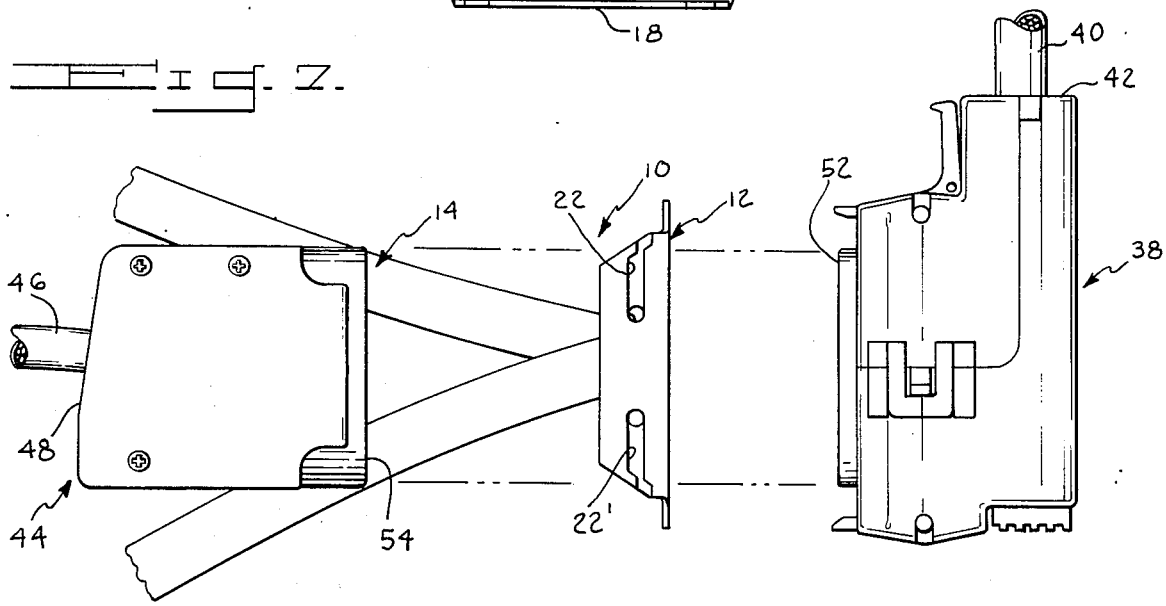
FIG. 7 is an exploded side elevation view of the adaptor of FIG. 6 prior to connecting a pair of mating cable connectors.
Figure 8:
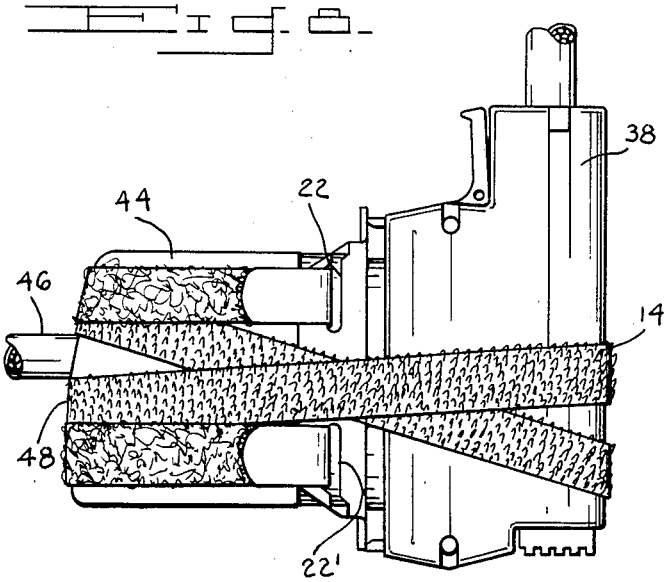
FIG. 8 is a side elevation view of the assembly of FIG. 7 subsequent to connection.
Figure 9:
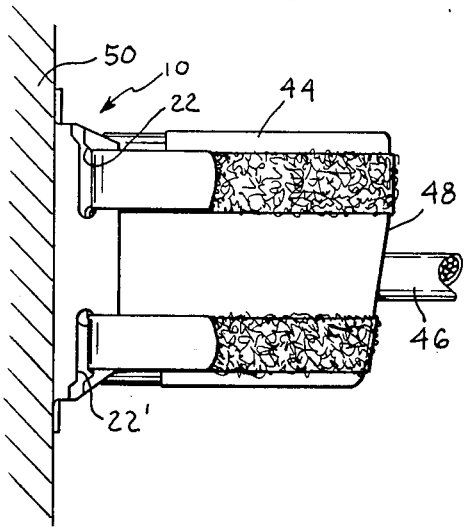
FIG. 9 is a side elevation view, partly in cross-section, of the adaptor of FIG. 6 being used in conjunction with mating connectors.

Electrical cable connectors of the type which will be secured together through the use of the adaptor of the present invention are depicted in FIGS. 7 through 9. As is evident from a review of the FIGURES, the cable connectors are of two types including a first type shown generally at 38 wherein the cable 40 extends laterally from the side 42 of connector 38; and cable connector 44 (second type) wherein the cable 46 extends outwardly from about the center of the top surface 48 thereof.

As discussed above, a problem inherent with the electrical connector hold down adaptor disclosed in U.S. Pat. No. 4,463,999 was that the self-locking strap used therein was wrapped about the cable connector such that it traveled over the middle of the top surface of the cable connector. While this positioning of the wrapped strap about a cable connector of the type identified at 38 wherein the cable extends laterally from the side of the housing poses no problems; clearly, strap 14 would be precluded from wrapping about the cable connector body if the cable extended outwardly from the center top surface of the connector bodies such as a cable connector of the type identified at 44.

In accordance with the bracket and strap assembly of the present invention, and as shown in FIGS. 8 and 9, unlike the prior art U.S. Pat. No. 4,463,999, strap 14 is wrapped over the two opposing end portions of top surface 48; rather than over the middle portion of top surface 48 of cable connector 44. Thus, there is no problem with cable 46 acting as an obstruction to strap 14. As shown in FIGS. 8 and 9, the adaptor of the present invention can be used to connect either a pair of cable connectors such as connectors 38 and 44 in FIG. 8; or a single cable connector to a mating connector which is mounted in a housing or enclosed unit such as the housing identified at 50 in FIG. 9. It will be appreciated that the adapter of the present invention may interconnect a pair of cable connectors, or a cable connector to a housing or enclosed unit wherein the cable connector or connectors may be of any type, including both laterally exiting cable connectors (38) and top exiting cable connectors (44).

In FIGS. 7 and 8, bracket 12 is positioned between cable connectors 38 and 44 with the two opposing ends of strap 14 being wrapped about the housing of connector 44 over top housing surface 48 and on either side of cable 46. The strap ends are then wrapped about the housing of cable connector 38, brought back up and over the top surface 48 (along either side of cable 46) of connector 44 whereupon each end is slipped into an open ended slot 22 or 22'. Next, the section of hooks or loops on the ends of strap 14 are releasable mated with adjacent sections of loops or hooks, respectively positioned along the strap (see FIG. 8). Bracket 12 may be permanently attached to either connector 38 or 44. As mentioned, central opening 28 is sized so as to receive the respective connecting portions 52 and 54 of cable connectors 38 and 44.

Referring to FIG. 9, a cable connector 44 is shown attached to a housing or unit (having an electrical connector incorporated therein) via the adapter 10 of the present invention. In this application of the present invention, strap 14 is simply wrapped about top surface 48 along either side of cable 46 whereupon the straps ends are slipped into open-ended slots 22 and 22' and releasably connected by the preferably hook and loop type connecting means. In this embodiment, bracket 12 should be permanently or releasably attached to the electrical connector incorporated in housing 50.

A second embodiment of an adaptor in accordance with the present invention is shown generally at 60 in FIGS. 10–13. Adaptor 60 also includes a bracket 62 and a strap, 64. Like bracket 12, bracket 62 is preferably formed as a metal stamping. Bracket 62 is generally "U" shaped with a flat bottom portion 66 and a pair of oppositely disposed flat arms or extensions 68 and 70 which extend outwardly therefrom. Arms 68 and 70 are preferably transversely oriented with respect to base 66 and have the irregular shape which may best be seen from FIG. 11. Arm 68 is provided with a pair of oppositely disposed closed-slots 72 and 72' which extend inwardly toward one another from opposed side surfaces 74 and 74' of arm 68. Arm 70 includes at least one closed slot 76. Slot 76 is preferably centrally disposed along arm 70. Bottom portion 66 of bracket 62 is provided with a substantially rectangularly shaped central cut-out 78. Additionally, in the preferred embodiment, base 66 is provided with a pair of oppositely disposed and aligned mounting openings 80.

As mentioned, the adaptor of the present invention also includes a strap 64 which is of the self locking type. In a preferred embodiment, strap 64 includes sections of hooks and loops. Strap 64 has a "Y" or folded configuration including diverging fork numbers 82 and 84 which originate at a unitary tongue 86. As shown in FIGS. 10–13, tongue portion 86 of strap 64 includes a section of hooks or loops thereon (in this case hooks) while fork numbers 82 and 84 include a section of loops or hooks thereon (in this case loops) in an area adjacent to the hooks on tongue 86. The hooks and loops on both tongue 86 and fork members 82, 84 are on the same surface of strap 64. It will be appreciated that when the adjacent areas of hooks and loops contact one another, a relatively strong attachment will be affected thereby. It will be understood that the particular configuration of the hooks and loops may be interchanged so long as the front of strap 64 has a group of hooks and loops at one end thereof (nearest tongue 86).

Figure 10:
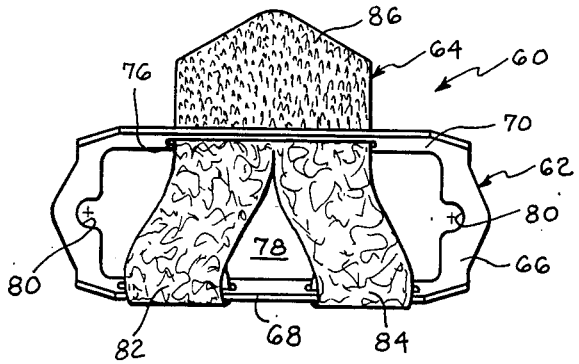
FIG. 10 is a top perspective view of an assembled bracket and strap in accordance with a second adaptor embodiment of the present invention.
Figure 11:
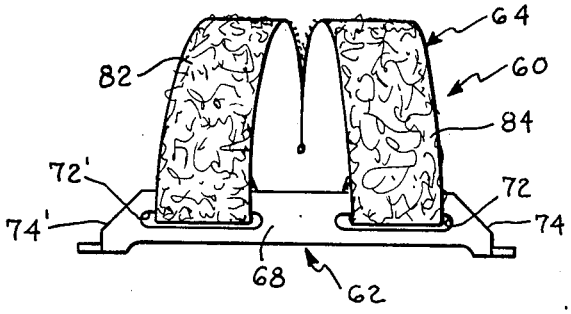
FIG. 11 is a side elevation view of the adaptor of FIG. 10.
Figure 12:
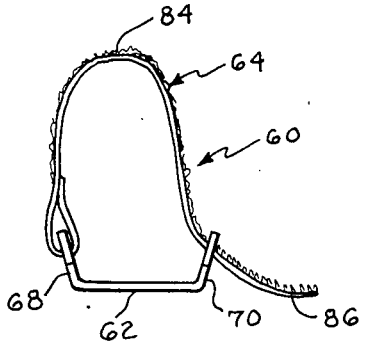
FIG. 12 is an end view of the adaptor of FIG. 10.

In FIGS. 10–12, adapter 60 is shown subsequent to assembly wherein one end of strap 64 has been passed through the pair of closed slots 72 and 72' of arm 68. Preferably a small amount of the fork members 82 and 84 of strap 14 are brought through slots 72 and 72', respectively, whereupon the strap may be permanently secured to bracket 62 by heat sealing or other means thereby securing strap 64 to itself so that strap surrounds portions of arm 68.

Figure 13:
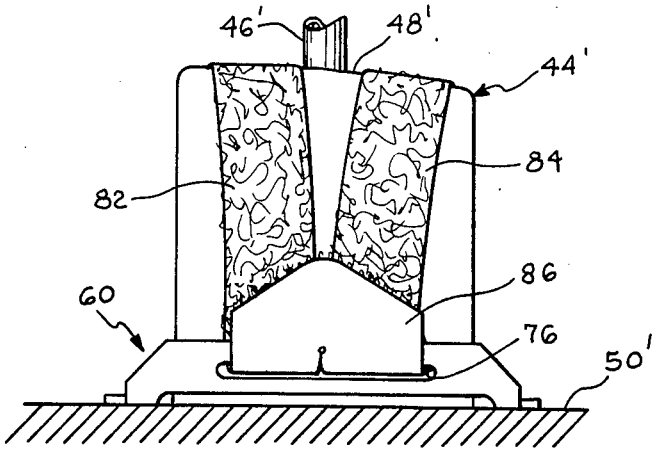
FIG. 13 is a side elevation view, partly in cross-section, of the adaptor of FIG. 10 being used in conjunction with mating connectors.

Referring to FIG. 13, a cable connector 44' is shown attached to a housing or unit 50' (having an electrical connector incorporated therein) via the adapter 60 of the present invention. In this embodiment of the present invention, strap 64, (actually fork members 82 and 84) is simply placed about top surface 48' along either side of cable 46' whereupon the tongue 86 of strap 64 is slipped into slot 76 and releasably connected by the preferably hook and loop type connection means. In this embodiment, bracket 62 should be permanently or releasably attached to the electrical connector incorporated in housing 50'.

It is believed that the embodiment of the present invention depicted in FIGS. 10–13 is preferable over the embodiment of FIGS. 1–9 due to the construction of strap 64 (relative to strap 14). However either embodiment is equally effective in overcoming the problems of the prior art as described above.

It will be appreciated that the various features and details unique to the two embodiments described herein may be used with either embodiment (FIGS. 1–9 and FIGS. 10–13) as described depending on the particular applications involved.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A retainer for releasably securing together a pair of mating electrical connectors, both of the connectors having a connection portion, at least one of the connectors having a body portion with the connection portion extending outwardly therefrom, the body portion also having a cable extending therefrom, the connection portions of both connectors being adapted to mate with each other, said retainer comprising:

a rigid bracket, said bracket having a substantially planer base portion with first and second oppositely disposed arms extending outwardly from said base portion at an angle, said first arm having at least a first slot extending therethrough, said second arm having a pair of oppositely disposed second slots extending therethrough, said base portion having an aperture extending therethrough, said aperture having a size and shape which permits the connection portions of electrical connectors to pass therethrough, said aperture having a cross-sectional area which is smaller than the cross-sectional area of the connector body portion; and a flexible strap, said strap including a first portion having loops and a second portion having flexible hook members extending outwardly from a first side thereof, and a third portion having flexible hook members and a fourth portion having loops extending outwardly from a second side thereof, said loops and hooks cooperating when brought into contact to releasably secure said first strap portion to said second strap portion, and said third strap portion to said fourth strap portion after said flexible strap is wrapped around at least one electrical connector, and strap passing through said first slot and said pair of slots in said bracket arms whereby said strap is attached to said bracket.

2. The retainer of claim 1 wherein:

said aperture in said bracket base portion is of a rectangular shape.

3. The retainer of claim 1 wherein said:

first and second arms define planes which are generally transverse to said base portion.

4. The retainer of claim 2 wherein:

said first and second arms define planes which are generally transverse to said base portion.

5. The retainer of claim 1 wherein:

said arms are substantially parallel.

6. The retainer of claim 5 wherein:

each of said pair of second slots are open-ended slots.

7. The retainer of claim 1 wherein:

said bracket is comprised of metal.

8. The retainer of claim 1 wherein:

said first slot is a closed slot.

9. The retainer of claim 8 wherein:

said first slot is centrally located on said first arm.

10. The retainer of claim 1 wherein:

said strap is permanently attached to said first arm at said first slot.

11. The retainer of claim 10 wherein said strap has a central portion and wherein:

said central portion of said strap is attached to said first arm.

12. A retainer for releasably securing together a pair of mating electrical connectors, both of the connectors having a connection portion, at least one of the connectors having a body portion with the connection portion extending outwardly therefrom, the body portion also having a cable extending therefrom, the connection portions of both connectors being adapted to mate with each other, said retainer comprising:

a rigid bracket, said bracket having a substantially planer base portion with first and second oppositely disposed arms extending outwardly from said base portion at an angle, said first arm having at least a first slot extending therethrough, said second arm having a pair of oppositely disposed second slots extending therethrough, said base portion having an aperture extending therethrough, said apterture having a size and shape which permits the connection portions of electrical connectors to pass therethrough, said aperture having a cross-sectional area which is smaller than the cross-sectional area of the connector body portion; and a flexible strap, said strap having a forked configuration including a pair of fork members diverging from a unitary base member, said flexible strap including a first portion having hooks thereon and a second portion having loops thereon, said hooks and loops being located on a first side of said strap, said loops and hooks cooperating when brought into contact to releasably secure said first strap portion to said second strap portion after said flexible strap is wrapped around at least one electrical connector, said unitary base member of said strap passing through said first slot and one each of said fork members passing through said pair of second slots in said bracket arms whereby said strap is attached to said bracket.

13. The retainer of claim 12 wherein;

said aperture in said bracket base portion is of rectangular shape.

14. The retainer of claim 12 wherein:

said first and second arms define planes which are generally transverse to said base portion.

15. The retainer of claim 12 wherein:

said arms are substantially parallel.

16. The retainer of claim 12 wherein:

said bracket is comprised of metal.

17. The retainer of claim 12 wherein:

said first slot is a closed slot.

18. The retainer of claim 17 wherein:

said first slot is centrally located on said first arm.

19. The retainer of claim 12 wherein:

said fork members of said strap are permanently attached to said second arm at said second slots.

20. The retainer of claim 12 wherein:

said hook and loop portions are located on said base member of said strap or on an area of said strap adjacent to said base member.

21. The retainer of claim 12 wherein:

said second slots are closed slots.

* * * * *